United States Patent [19]

Skinner

[11] 4,041,920

[45] Aug. 16, 1977

[54] FUEL INJECTION PUMPING APPARATUS

[75] Inventor: Robert Thomas John Skinner, High Wycombe, England

[73] Assignee: C.A.V. Limited, Birmingham, England

[21] Appl. No.: 722,403

[22] Filed: Sept. 13, 1976

Related U.S. Application Data

[63] Continuation of Ser. No. 598,129, July 22, 1975, abandoned.

[30] Foreign Application Priority Data

July 26, 1974 United Kingdom ..... 33029/74

[51] Int. Cl.[2] ..... F02D 1/02

[52] U.S. Cl. ..... 123/139 AM; 123/140 FG; 417/251; 417/253; 417/294

[58] Field of Search ..... 73/522; 123/140 R, 140 FG, 123/140 J, 139 K, 139 L, 139 AQ, 139 AY, 139 AD, 139 AM; 417/244–253, 293, 294, 462

[56] References Cited

U.S. PATENT DOCUMENTS

| | | | |
|---|---|---|---|
| 324,459 | 8/1885 | Corliss | 73/522 |
| 704,270 | 7/1902 | Reynolds | 73/522 |
| 1,265,883 | 5/1918 | Church | 73/522 |
| 2,454,578 | 11/1948 | Smith | 123/139 AL |
| 2,984,112 | 5/1961 | Parks | 73/522 |
| 3,536,421 | 10/1970 | Kemp | 417/253 X |
| 3,915,140 | 10/1975 | Parks et al. | 123/140 FG |
| 3,927,654 | 12/1975 | Perr | 123/140 FG |

FOREIGN PATENT DOCUMENTS

| | | | |
|---|---|---|---|
| 177,386 | 3/1922 | United Kingdom | 73/522 |

*Primary Examiner*—Carroll B. Dority, Jr.
*Assistant Examiner*—Tony M. Argenbright

[57] ABSTRACT

A fuel injection apparatus includes an axially movable member movable to determine the amount of fuel supplied by the apparatus. The member is acted upon by a weight mechanism including pivotal weights the force exerted by which is opposed by a governor spring adjustable from the exterior of the apparatus. Increase of the force exerted by the spring can result in sudden movement of the member so that temporarily too much fuel is supplied to the engine. This difficulty is minimized by providing a dash-pot which restricts the rate of movement of the member under the action of the governor spring at low engine speeds. The dash-pot is combined with a resilient means the force exerted by which is less than that of the governor spring at moderate engine speeds so that the dash-pot action is only obtained at low engine speeds.

4 Claims, 3 Drawing Figures

FUEL INJECTION PUMPING APPARATUS

This is a continuation, of application Ser. No. 598,129 now abandoned filed July 22, 1975.

This invention relates to fuel injection pumping apparatus for supplying fuel to internal combustion engines, and of the kind comprising an injection pump, a feed pump for supplying fuel under pressure to the injection pump, an axially movable member disposed in a surrounding body, an adjustable orifice defined by the member and body the size of said orifice determining the amount of fuel supplied to the engine at each injection stroke by the injection pump, a pivotal centrifugal weight acting on one end of the member and urging the member in an axial direction to reduce the size of said orifice, a governor spring acting to urge the member against the action of said weight, and operator adjustable means for varying the force exerted by said spring, the arrangement being such that the weight, spring and orifice together constitute a governor to control the speed of the associated engine in accordance with the setting of the operator adjustable means.

With such an apparatus, when the operator effects movement of said means to increase the engine speed, a rapid increase in the size of the orifice takes place, and this can cause a problem at low engine speeds when overfuelling of the engine can occur, and the subject of the invention is to provide such an apparatus in a form in which the risk of overfuelling is minimised.

According to the invention, an apparatus of the kind specified comprises a reaction member for the pivot of said weight, resilient means, said resilient means acting to urge the reaction member and pivot in opposition to said governor spring, and a dash-pot acting to limit the rate of movement of the reaction member against the action of said resilient means when the force exerted by the governor spring is increased.

One example of a fuel pumping apparatus in accordance with the invention will now be described with reference to the accompanying drawings, in which.

Figure 1:
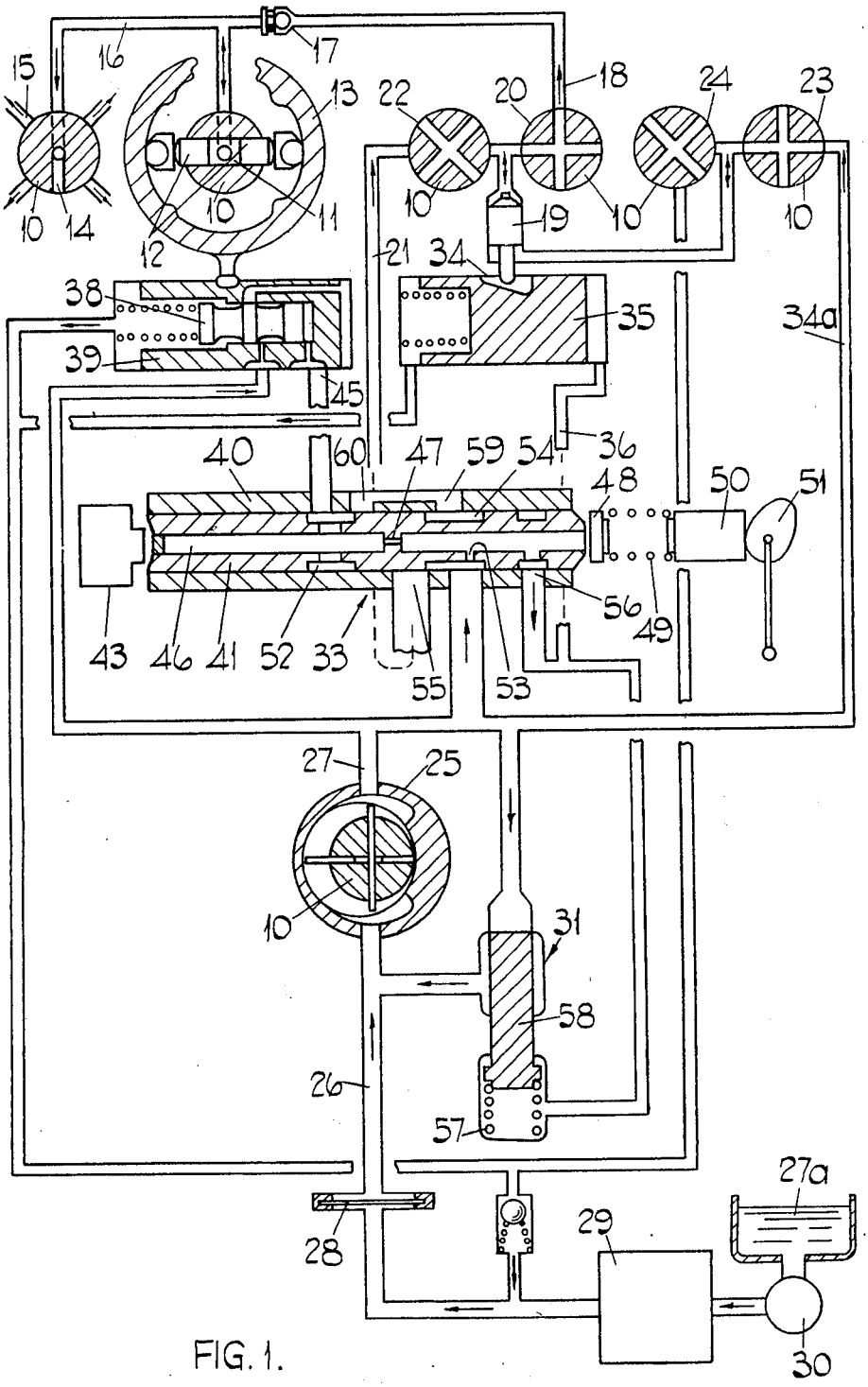
FIG. 1 is a diagrammatic illustration of the apparatus.

Referring to FIG. 1 of the drawings, the apparatus comprises a body part in which is journalled a rotary cylindrical distributor member 10 which is shown divided into seven parts. The distributor member is adapted to be driven in timed relationship with the engine with which the apparatus is associated, and at one point in the distributor member, there is formed a transversely extending bore 11 in which is mounted a pair of reciprocable pumping plungers 12. Surrounding the distributor member at this point, is an annular cam ring 13 having on its internal periphery, a plurality of pairs of diametrically disposed cam lobes. The cam lobes through the intermediary of rollers respectively, act upon rotation of the distributor member, to move the pumping plungers 12 inwardly thereby to expel fuel contained within the transverse bore 11. The pumping plungers 12, together with the cam lobes constitute an injection pump.

The transverse bore 11 communicates with a passage 16 extending within the distributor member, and at one point this passage communicates with an outwardly extending delivery passage 14 which is adapted to register in turn, and as the distributor member rotates, with a plurality of outlet ports 15 formed in the body part. The outlet ports in use, are connected to the injection nozzles respectively of the associated engine.

The passage 16 is in communication by way of a check valve 17 with a passage 18, and this passage can be brought into communication with one end of a bore containing a slidable shuttle 19 by means of a rotary valve 20. The aforesaid one end of the bore at other times, as will be explained, can be placed in communication with a feed passage 21 by means of a rotary valve 22.

The other end of the bore containing the shuttle 19 can be placed in communication with a source of fuel at a high pressure by means of a rotary valve 23 or with a source of fuel at low pressure by means of a rotary valve 24. The valves 20, 22, 23 and 24 are formed in or on the distributor member 10, and of course are driven in timed relationship with the engine. In addition, also mounted on the distributor is a feed pump 25 of the rotary vane type, and having an inlet 26 and an outlet 27. The inlet 26 is in communication with a supply of fuel **27*a* by way of a pair of filter units 28, 29 and a lift pump 30 is provided to ensure the supply of fuel to the feed pump. The output pressure of the feed pump 25 is controlled by a relief valve 31 the function of which will be described later in the specification. The outlet 27 of the feed pump communicates by way of a passage 34*a* with the valve 23**, the purpose of which has already been explained.

The operation of the apparatus thus far described is as follows. With the parts of the apparatus in the positions shown in FIG. 1, fuel is flowing from the outlet of the feed pump by way of the valve 23 to said other end of the bore containing the shuttle 19, and the shuttle 19 is being moved inwardly towards said one end of the bore. Fuel is therefore displaced from this end of the bore and flows by way of the rotary valve 20 and the check valve 17, to the passage 16 and particularly to the bore 11. The plungers 12 are therefore moved outwardly by an amount dependent upon the quantity of fuel displaced by the shuttle 19.

During continued rotation of the distributor member, the passage 14 is brought into register with an outlet port 15, and during this time the plungers 12 are moved inwardly, and fuel is displaced from the bore 11 to the appropriate engine cylinder. Also during this time, the rotary valves 20 and 23 are closed, and the valves 22 and 24 are open so that fuel now flows to said one end of the bore containing the shuttle 19, and the shuttle is therefore moved outwardly towards the other end of the bore. The quantity of fuel which is supplied to the bore containing the shuttle is controlled by a metering valve 33 which will be described later, and this therefore determines the quantity of fuel which is supplied to the injection pump during a filling stroke, and thereby the amount of fuel which is supplied to the associated engine at each injection stroke of the injection pump. During continued rotation of the distributor member, the process described is repeated, and fuel is supplied to the engine cylinders in turn.

It will be appreciated that the shuttle 19 determines the maximum quantity of fuel which can be supplied by the apparatus at each injection stroke. This maximum quantity of fuel is varied in accordance with the speed of the engine to provide shaping of the maximum fuel characteristic, and for this purpose the maximum excursion of the shuttle is made to vary in accordance with the speed of the engine. The shuttle 19 is provided with an extended end portion which can co-operate with a cam surface 34 formed on a spring loaded piston 35. The piston is movable against the action of its spring by means of fuel supplied under pressure to one end of the cylinder by way of a passage 36. The pressure of the fuel which is supplied to the passage is dependent upon the speed at which the apparatus is driven, and the way in which it is derived will be explained later. The effect is that the axial setting of the piston 35 will be dependent upon the speed of the associated engine, and thereby the allowed excursion of the shuttle 19 will also be dependent upon the engine speed.

There is also provided a fluid pressure operable member in the form of a servo-piston 39, and this is connected to the cam ring 13 by means of a peg. The piston 39 is provided with a bore in which is mounted a spring loaded servo-valve 38. The servo-valve controls the admission or escape of fuel under pressure to and from one end of the cylinder containing the piston 39. The fuel under pressure is obtained from the outlet 27 of the feed pump, and the servo-valve 38 is subjected to a pressure existing in a conduit 45. As this pressure increases, the servo-valve 38 will be moved against the action of its spring loading towards the left as seen in FIG. 1, and the servo-piston 37 will follow this movement, thereby moving the cam ring 13 angularly and altering the timing of injection of fuel to the engine.

Considering now the metering valve 33. This comprises a sleeve 40 which is fixed within the body part of the apparatus. Within the sleeve, there is mounted an axially movable rod member 41 which at one end is acted upon by a weight mechanism 43 which will be described in greater detail with reference to FIGS. 2 and 3, but which includes a pair of centrifugal weights which are rotated at a speed directly proportional to the speed at which the engine is driven.

Extending axially within the rod member is a bore 46 which at its end adjacent the weight mechanism is closed by a plug. Moreover, intermediate its ends, the bore is provided with a restrictor 47. At its opposite end, the bore 46 is obturated by a valve member 48, the latter being loaded by means of a coiled compression spring 49. The opposite end of the coiled compression spring is engaged by operator adjustable means comprising a movable abutment 50, the axial setting of which and thereby the force exerted by the spring 49 can be adjusted by means of a cam 51 connected to a control pedal of the vehicle. The portion of the bore 46 which is closed by the plug, is in constant communication with the conduit 45, this being achieved by a circumferential groove 52 formed on the rod member, and which is in constant communication with a port in the sleeve 40 and communicating with the conduit 45. The other end of the passage 46, is in communication by way of a restrictor 53, with a further circumferential groove 54 formed on the rod member. Moreover, formed in the sleeve is a port 55 which is in communication with the passage 21. The port 55 is positioned so that the groove 54 can have partial registration therewith so as to define an adjustable orifice through which fuel can flow to the injection pump from the feed pump 25 the outlet 27 of which is in constant communication with the circumferential groove 54.

The right hand portion of the bore 46 is in constant and unrestricted communication by way of a further circumferential groove and a port 56, with the passage 36 which communicates with one end of the cylinder containing the piston 35. In addition, the port 56 is in communication with the chamber containing the spring 57 which loads the valve member 58 of the relief valve 31. The spring 57 urges the valve member 58 towards the closed position in which no fuel is spilled from the outlet of the feed pump. Finally, there is formed in the sleeve, a pair of spaced and communicating ports 59, 60. The port 59 is in constant communication with the circumferential groove 54, and the port 60 can register to a varying amount depending upon the axial position of the rod member 41, with the circumferential groove 52. The port 60 and circumferential groove 52 constitute a restricted orifice.

In operation, the axial setting of the rod 41 is dependent upon the speed at which the engine is driven, and as the engine speed increases, the weights in the weight mechanism 43 will effect movement of the rod member 41 towards the right as seen in FIG. 1. This movement of course takes place against the action of the spring 49. As explained, the force exerted by the spring 49 can be varied, and if the spring force is increased, then for a given engine speed, the rod member will move towards the left against the action of the weights. As a result of such movement, the effective size of the orifice which is in series with the passage 21 and the outlet of the feed pump is increased, so that more fuel will be supplied to the engine. The fuel pressure existing in the right hand end of the bore 46 is by virtue of the restrictor 53 and the valve member 48, proportional to the square of the speed at which the engine is driven. In practice, the valve member 48 will be lifted slightly from the end of the passage 46 so that flow of fuel will occur through the restrictor 53.

The pressure in the right hand end of the passage 46 is allowed to act upon the valve member 58 of the relief valve, and in so doing it enhances the force exerted by the spring 57, the output pressure of the feed pump will therefore have a value represented by the law $N^2 + K$ where N is the speed at which the apparatus is driven, and K is a constant depending upon the spring 57. The weights, together with the orifice defined by the port 55 and the groove 54, and the spring 49 constitute a governor which controls the speed of operation of the engine. With the arrangement described, if the operator should suddenly effect an increase in the force exerted by the spring 49, then the rod member will immediately move to the left to cause a rapid increase in the amount of fuel supplied to the engine. At low engine speeds this can cause problems with temporary overfuelling of the engine, whereas at higher speeds this problem does not arise.

Figure 2:
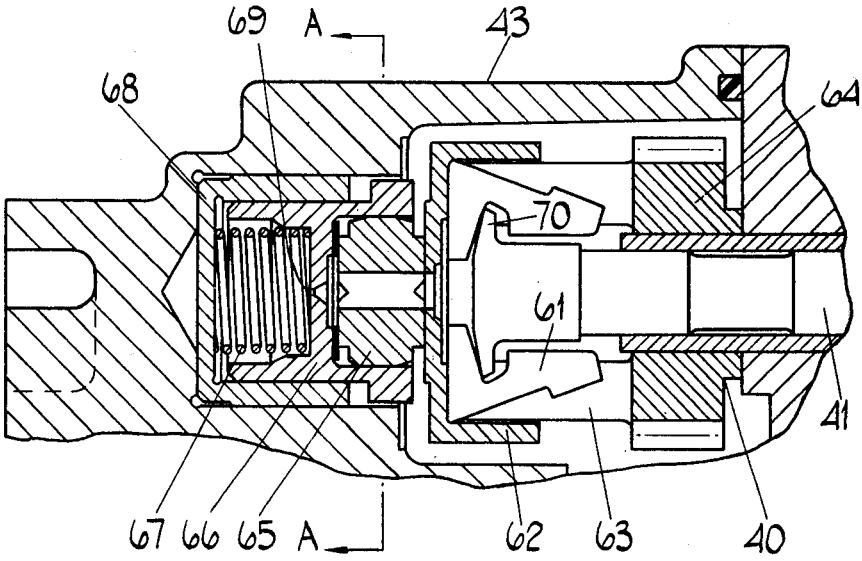
FIG. 2 is a sectional side elevation of a portion of the apparatus seen in outline only in FIG. 1.
Figure 3:
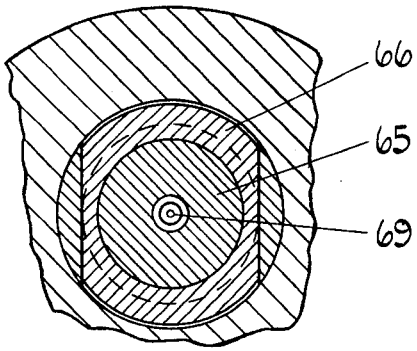
FIG. 3 is a section on the line A—A of FIG. 2.

Turning now to FIGS. 2 and 3, which show in greater detail the construction of the weight mechanism 43, it will be seen that the rod member 41 is provided with an outwardly extending flange 70, against which the toe portions of the weights 61 engage. The heel portions of the weights pivot against a complementary surface formed in a cage 62 which is of generally cup shaped form, but which has extended portions 63 which are connected to a gear wheel 64 mounted about an extension of the sleeve 40. The gear wheel 64 is conveniently coupled by gearing to the distributor member 10 so that the cage rotates at a speed proportional to the engine speed.

The cage 62 constitutes a reaction member for the weights, and engages a thrust member 65 which is itself accommodated within a recess formed in an axially movable spring abutment 66. The abutment 66 defines a recess for a further spring 67, the other end of this spring being located against the base wall of a cup shaped member 68 secured within the body part of the apparatus. The abutment 66 and the cup shaped member 68 define a dash-pot, and it will be noted that the abutment 66 is provided with a restricted aperture 69 which can restrict the rate of flow of liquid out of the dash-pot. It will further be noted that the first member 65 is provided with a central aperture, and that the end faces of the thrust member are notched so as to allow fuel to flow into and out of the dash-pot.

The strength of the coiled compression spring 67 is such that at low engine speeds, i.e., up to about 400 revolutions per minute, the force exerted by the spring 67 is greater than that which is developed by the spring 49, when the engine is running with the governor in a position of equilibrium. As a result, the cage 62 is moved its maximum extent towards the right, and assumes the position in which it is shown in FIG. 2. Moreover, in this equilibrium position, the weights 61 will have moved outwardly a small extent from the position in which they are shown in FIG. 2. If now the operator moves the throttle pedal so as to obtain maximum speed, the immediate effect will of course be to increase the force exerted by the spring 49, and this in turn will cause axial movement of the rod member 41, and the weights 61 will be moved to the position in which they are shown in FIG. 2. In this position, axial movement of the rod member 41 temporarily halted. It will be appreciated however, that with the throttle pedal fully depressed, the force exerted by the spring 49 will be greater than that of the spring 67, and therefore a gradual collapse of the dash-pot will occur. During collapse of the dash-pot, the rod member 41 will move under the action of the spring 49, and there will be a progressive increase in the amount of fuel supplied to the engine, until the normal governing action takes place. The rate of increase of fuel which occurs, will of course depend upon the size of the orifice 69 in relation to the displacement of the dash-pot, and this can be chosen to give the required rate. Moreover, it will be appreciated that the strength of the spring 67 can be arranged so that the dash-pot action as described, takes place up to any desired speed of the engine.

At increased engine speeds with the governor in a position of equilibrium the force exerted by the governor spring 49 will be greater than the force exerted by the spring 67. As a result the spring 67 will be compressed to the extent determined by the contact of the cup shaped member 68 with the abutment 66. As a result there will be no relative movement of these two components as described when the rod member 41 is moved to increase the supply of fuel to the associated engine.

I claim:

1. In a fuel injection pumping device having an injection pump for supplying fuel to an internal combustion engine, a feed pump for supplying fuel to said injection pump, a metering device between said fuel pump and said injection pump including a body, an axially movable control member within said body for controlling the amount of fuel supplied to said injection pump, a first biasing means at one end of said control member for urging said control member axially to increase the amount of fuel to said injection pump, and centrifugal weight means at the other end of said control member and rotatable as a function of the speed of the engine to exert a force opposing the force of said first biasing means to restrict movement of said control member by said first biasing means and means operable for increasing the force exerted by said first biasing means to move said control member against said centrifugal weight means to increase the supply of fuel to said injection pump, the improvement of a dash pot means for retarding sudden movement of said control member when the force exerted by said biasing means is increased by said operable means against said centrifugal weight means and comprising cage means engaging said centrifugal weight means and movable coaxially of said control member, means for rotating said cage means at a speed proportional to the speed of the engine, movable abutment means engaging said cage means and a second biasing means urging said abutment means against said cage means for opposing the force of said first biasing means, said body being provided with a fluid filled recess housing said cage means, said abutment means and said second biasing means, said abutment means dividing said recess into two chambers and being provided with a restricted aperture for communication of the fluid therethrough between said two chambers whereby when the force of said first biasing means is increased by said operable means, the movement of said control member is retarded by the dash pot means so that an excessive increase of fuel to the engine is temporarily prevented.

2. A fuel injection pumping device as claimed in claim 1 wherein said abutment means comprises a first movable element within the recess in said body engaging one end of said second biasing means and second movable element disposed between said first element and said cage means, said first element having the restricted aperture therein and said second element having a passage therethrough communicating with said restricted aperture.

3. A fuel injection pumping device as claimed in claim 1 wherein said second biasing means comprises a coiled compression spring for biasing said abutment means.

4. A fuel injection pumping device as claimed in claim 2 wherein said first movable element is provided with means for limiting the movement of said cage means and said second element when the force of said first biasing means is increased by said operable means

* * * * *